United States Patent [19]

Vo et al.

[11] 4,229,743

[45] Oct. 21, 1980

[54] MULTIPLE BAND, MULTIPLE RESONANT FREQUENCY ANTENNA

[75] Inventors: Thang Vo, Columbia; John R. Lewis, Jr., Newberry, both of S.C.

[73] Assignee: Shakespeare Company, Columbia, S.C.

[21] Appl. No.: 945,055

[22] Filed: Sep. 22, 1978

[51] Int. Cl.[3] ..... H01Q 1/32; H01Q 9/27

[52] U.S. Cl. ..... 343/749; 343/895

[58] Field of Search ..... 343/722, 715, 750, 752, 343/792, 895, 749

[56] References Cited

U.S. PATENT DOCUMENTS

| | | | |
|---|---|---|---|
| 2,898,590 | 8/1959 | Pichitino | 343/722 |
| 2,966,678 | 12/1960 | Harris | 343/895 |
| 2,966,679 | 12/1960 | Harris | 343/895 |
| 3,176,298 | 3/1965 | Nettles | 343/749 |
| 3,689,928 | 9/1972 | Felsenheld | 343/752 |
| 3,725,942 | 4/1973 | Ukmar | 343/715 |
| 4,117,493 | 9/1978 | Altmayer | 343/750 |

OTHER PUBLICATIONS

Takechi, "Unequal-Multiconductor Unipole Antennas" in Electronics & Communications in Japan (5-1966) pp. 45-53.

*Primary Examiner*—Eli Lieberman

*Attorney, Agent, or Firm*—Hamilton, Renner & Kenner

[57] ABSTRACT

An antenna (10) suitable for multiple frequency band utilization includes three impedance elements (11,12 and 13). The second impedance element (12), which may also be called a network (12), includes a coil ($L_2$) and at least one other conductor (17) in operative association therewith. The second impedance element may be electrically connected to both a first impedance element (11), which may include a linear conductor (14) coupled to a radio, and a third impedance element (13), which may include a coil ($L_1$). By constructing the network (12) so as to have appropriate dimensions, antenna 10 will have a plurality of natural resonant frequencies substantially within or nearby at least each higher band of frequencies of interest.

6 Claims, 6 Drawing Figures

AT 100 MHz
AT 108 MHz
AT 100 MHz
LENGTH
CURRENT (μA)
0
1.0
2.0
1.0
2.0
3.0

AT 88 MHz
AT 27.1 MHz
AT 88 MHz
LENGTH
CURRENT (μA)
0.8
0
1.0
2.0
10
L1
13
18
L2
12
16
17
11
14
15
TO RADIO

C1
L1
R1
Z1
13
Z2
L2
C2
R2
12
C3
11
R3

MULTIPLE BAND, MULTIPLE RESONANT FREQUENCY ANTENNA

TECHNICAL FIELD

The present invention relates generally to a multiband, radio antenna. More particularly, the present invention concerns a multiband, radio antenna having a plurality of resonant frequencies, occurring as desired throughout the frequency bands of interest.

BACKGROUND ART

With the increased popularity in recent years of FM broadcast and Citizen Band radios, a need has arisen for a single antenna, suitable for mobile use (as on a motor vehicle) that would permit adequate AM and FM broadcast reception and both Citizen Band transmission and reception. This in turn required that the antenna be tuned to resonate at frequencies in both the FM (88.0–108.0 MHz) and CB (26.96–27.23 MHz) bands.

However, in the past the so-called multiple band antennas actually had only one natural resonant frequency. Such antennas were operated in one of two manners. Most antennas had to be separately matched and tuned for operation each time a different frequency band was selected for use, a difficult, costly, and often time consuming procedure, and one for which most users, being layman, were ill prepared. Other antennas were matched and tuned to a single supercritical frequency by the user after installation was complete. Not only was such single frequency matching and tuning extremely difficult if not impossible for the layman not having sophisticated field sensing equipment, but, even if properly accomplished, such was wholly inadequate for sufficient antenna efficiency over the widely separated AM, CB and FM frequency bands.

DISCLOSURE OF INVENTION

It is, therefore, an object of the present invention to provide a single antenna, suitable for use on a plurality of frequency bands throughout the electromagnetic radio spectrum.

It is another object of the present invention to provide a single antenna, as above, having a plurality of resonant frequencies occurring as desired in or nearby the radio frequency bands of interest.

It is still another object of the present invention to provide a single antenna, as above, in which each desired resonant frequency of the antenna occurs naturally without the need for initial installation rematching and retuning or subsequent rematching and retuning each time a different band is selected for use.

It is yet another object of the present invention to provide a single antenna, as above, in which the antenna has offsetting reactance at the AM broadcast frequency band for substantially resistive operation, and has resonant frequencies naturally occurring in or nearby the FM broadcast frequency band and the Citizens Radio frequency band, thereby providing increased antenna efficiency at these frequencies of interest.

It is a further object of the present invention to provide a single antenna, as above, on a plurality of frequency bands throughout the electromagnetic radio spectrum and having a plurality of antiresonant frequencies occurring as desired in or nearby the radio frequency bands of interest.

It is yet a further object of the present invention to provide a single antenna, as above, suitable for mobile use.

These and other objects and advantages of the present invention over existing prior art forms will become more apparent and fully understood from the following description in conjunction with the accompanying drawings.

In general, an antenna embodying the concept of the present invention must be used with at least one radio and would include an element for providing a first impedance, and an element for providing a second impedance coupled to the element for providing a first impedance and including a network for optimizing antenna impedance variations with frequency, resulting in the antenna having a plurality of resonant frequencies throughout the range of frequencies of interest.

A PREFERRED EMBODIMENT FOR CARRYING OUT THE INVENTION

Figures 1, 2, 3, 4:
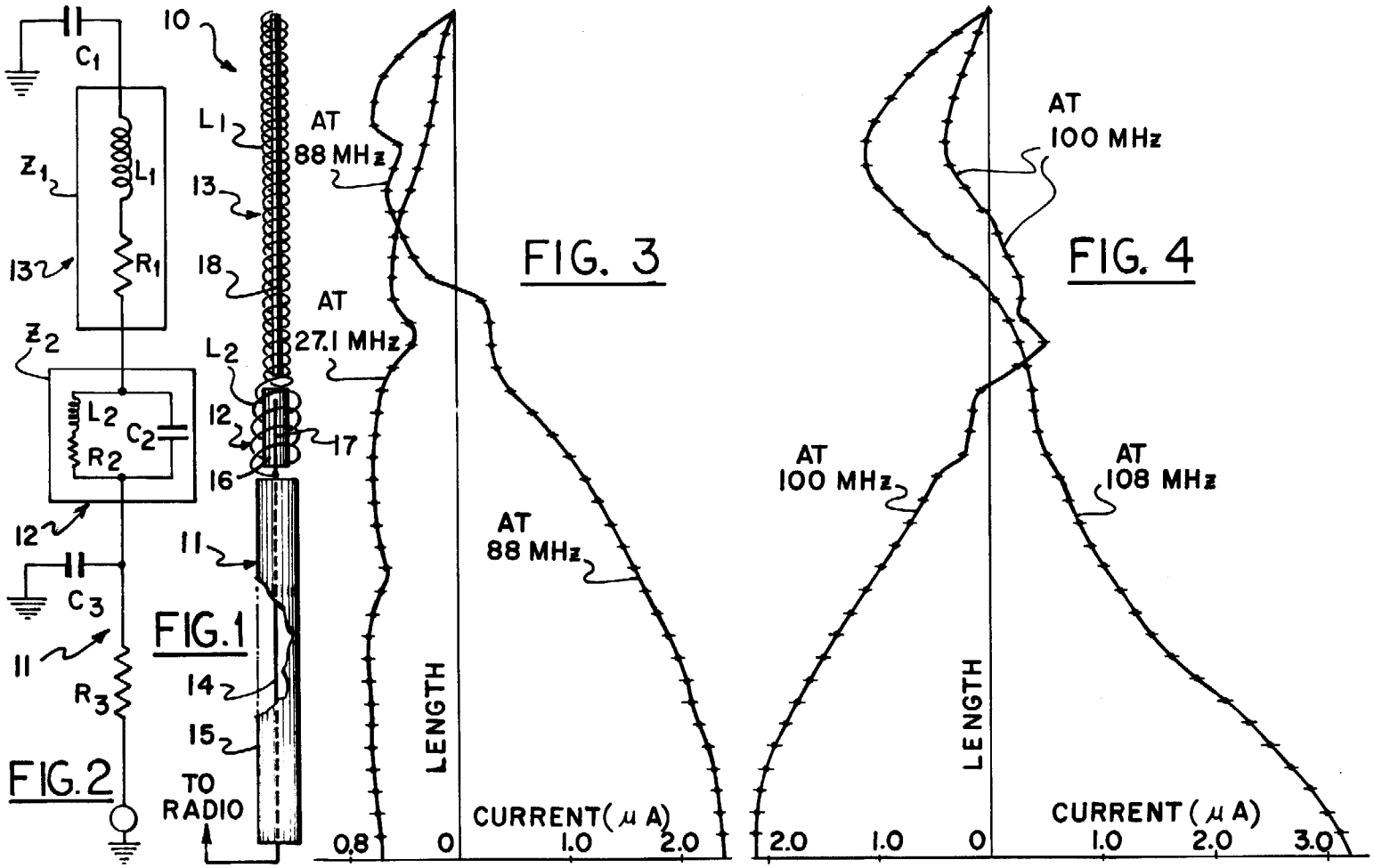
FIG. 1 is a front view of an exemplary antenna according to the concept of the present invention.
FIG. 2 is a schematic diagram of the lumped-circuit electrical model at low frequencies for the exemplary antenna depicted in FIG. 1.
FIG. 3 is the current distribution actually measured for the exemplary antenna depicted in FIG. 1 at 27.1 MHz and at 88 MHz.
FIG. 4 is the current distribution actually measured for the exemplary antenna depicted in FIG. 1 at 100 MHz and at 108 MHz.

FIG. 1 depicts an exemplary antenna embodying the concept of the present invention, which is generally indicated by the numeral 10. Antenna 10 includes a first impedance element 11, a second impedance element 12 and a third impedance element 13. First impedance element 11 includes a linear conductor 14 of a length to be hereinafter specified having any conventional dielectric material 15, such as fiberglass or plastic, positioned therearound for rigidity and protection. One end of first impedance element 11 is coupled, either directly or electromagnetically, to at least one radio, while its other end is coupled to the second impedance element 12. Utilizing the well-known lumped-circuit modeling techinque for antennas and transmission lines, first impedance element 11 may be modeled at low frequencies as a simple unloaded vertical radiator having a series D.C. resistance $R_3$ and some capacitance $C_3$ to ground, as shown in FIG. 2. Although the impedance elements 11, 12 and 13 shall be described in ascending order (from the radio outward), for the purpose of consistancy with formuli and calculations to be discussed hereinafter, the individual lumped-circuit components shall be numbered in decending order (from the outermost portion of antenna 10 inward toward the radio).

Impedance element 12 includes a continuously wound coil $L_2$ formed around dielectric material 16 which may be similar to dielectric material 15, and a linear conductor 17 positioned along the longitudinal axis of antenna 10 in the center of dielectric material 16. Coil $L_2$ may be modeled in FIG. 2 as having an inductance $L_2$ in series with a resistance $R_2$. Linear conductor 17 may be electrically connected to either end of coil $L_2$, but must not in any event be electrically connected to both ends. When electrically connected in this manner, conductor 17 acts in operative association with coil $L_2$ as a capacitor $C_2$ in parallel with coil $L_2$, both of whose values vary with frequency. As detailed below, this network, which has a total impedance of $Z_2$, optimizes the total antenna impedance so as to obtain the desired multiple antenna resonant frequencies. Because the values of $L_2$, $R_2$ and $C_2$, of course, determine impedance $Z_2$, the dimensions of both coil $L_2$ and conductor 17 must be carefully selected as set forth hereinafter. The distributed capacitive reactance of the coil $L_2$ itself is negligible with respect to the capacitive reactance induced by linear conductor 17 and may be ignored without adverse effect.

The end of continuously wound coil $L_2$ opposite that coupled to impedance element 11 is coupled to impedance element 13. Impedance element 13 includes another continuously wound coil $L_1$ formed about dielectric material 18, which also may be similar to dielectric material 15. Coil $L_1$ may be modeled in FIG. 2 as having inductance $L_1$ in series with resistance $R_1$, together comprising impedance $Z_1$.

Antenna 10 is preferably mounted vertically with respect to the earth to obtain vertical polarization. Where antenna 10 is to be operated mobile as on a motor vehicle, all three impedance elements 11, 12 and 13 may be encapsulated in a suitable dielectric protective housing such as fiberglass, plastic or the like and affixed to a base mounting assembly (not shown) in the manner of a conventional whip antenna.

In order to obtain the desired multiple band resonance where the higher frequency bands of interest are the CB and FM frequency bands, it is necessary for the components of second impedance element 12, which also may be known as the optimizing network, to be selected such that impedance element 12 has its resonant frequency greater than the lowest desired antenna resonant frequency and less than the highest desired antenna resonant frequency. For example, with the CB and FM frequency bands (having midband frequencies of approximately 27.09 MHz and 98.00 MHz, respectively) selecting the dimensions of coil $L_2$ such that impedance element 12 resonates at approximately 59 MHz yields antenna resonances at both approximately 27 MHz and 98 MHz for the impedance section dimensions noted below.

In order to more fully understand the operation of antenna 10, and further to appreciate how the various dimensions of the impedance sections 11, 12 and 13 may be selected for the desired resonance frequencies, it is helpful to view antenna 10 as a "lossy" transmission line and calculate its impedance characteristic with frequency.

From Chapter 18 of the book *Antennas and Transmission Lines* by John A. Kuecken, the impedance of the various components of antenna 10 are as follows:

$$Z_{C1} = \frac{-j}{\omega C_1} \text{ OHMS} \tag{1}$$

$$Z_1 = jZ_{01} \tan \beta_1 l_1 \text{ OHMS} \tag{2}$$

$$Z_2 = jZ_{02} \tan \beta_2 l_2 \text{ OHMS} \tag{3}$$

-continued $$Z_{C3} = \frac{-j}{\omega C_2} \text{ OHMS; OR} \tag{4}$$

$$Z_{C3} = \frac{-jZ_{03}}{\tan \beta_3 l_3} \text{ OHMS} \tag{5}$$

where $Z_{C1}$, $Z_1$, $Z_2$, and $Z_{C3}$ equal the impedance of capacitance $C_1$, impedance element 13, impedance element 12, and capacitance $C_3$, respectively; $Z_{01}$, $Z_{02}$, and $Z_{03}$ equal the characteristic impedance of impedance elements 13 and 12, and conductor 14, respectively; $\beta_1$, $\beta_2$, and $\beta_3$ equal the phase factor of impedance element 13, impedance element 12, and capacitance $C_3$, respectively; and, $l_1$, $l_2$, and $l_3$ equal the length of impedance element 13, impedance element 12, and of conductor 14, respectively. As the resistance $R_3$ is negligible with respect to the impedance of the other components of antenna 10 at low frequencies, it may be ignored in determining the total impedance characteristic of antenna 10. Thus, from FIG. 2, it can be observed that the total input impedance of antenna 10 is the total series impedance $Z_{C1}+Z_1+Z_2$ in parallel with $Z_{C3}$ or $$Z_{IN} = \frac{(Z_{C1} + Z_1 + Z_2)(Z_{C3})}{(Z_{c1} + Z_1 + Z_2) + Z_{C3}} \text{ OHMS} \tag{6}$$

Equations (1) through (4) may be substituted into equation (6) and the result reduced. Using the well-known analysis technique of zeros and poles, the numerator may be set equal to zero yielding series resonant frequencies, $f_R$, at $$f_R = \frac{1}{C_1(Z_{01} \tan \beta_1 l_1 + Z_{02} \tan \beta_2 l_2)} \text{ Hz} \tag{7}$$

and the denominator set equal to zero yielding antiresonant frequencies, $f_{AR}$, at $$f_{AR} = \frac{1}{C_3[1 - (Z_{01} \tan \beta_1 l_1 + Z_{02} \tan \beta_2 l_2)]} \text{ Hz} \tag{8}$$

Because of the periodic nature of the tangent trigonometric function, equations (7) and (8) indicate that antenna 10 may be utilized to obtain an infinite number of both series resonant and antiresonant frequencies without any antenna initial installation tuning or subsequent retuning whatsoever. However, as a result of the actual, non-ideal nature of impedance elements 13 and 12, less than an infinite number of resonant and antiresonant frequencies are actually achievable. We have found that at least three resonant and antiresonant frequencies may be actually realized. Moreover, where impedance element 12 is tuned to resonant at a frequency greater than the lowest desired antenna resonant frequency and less than the highest desired antenna resonant frequency, the resulting resonant frequencies have ideal separation for effectuating resonance in or nearby both the Citizens Radio and FM broadcast bands. Such an antenna is excellently suited for reception of the AM and FM broadcast bands and both reception of and transmission on Citizens Radio bands, and may be referred to as a multiple band antenna having multiple resonant frequencies.

Determination of antenna 10 component dimensions necessary for operation in the desired frequency bands requires either completion of the antenna 10 impedance characteristic calculation begun hereinabove or an emperical study of the various component dimension combinations. For explanatory purposes the former approach has been adopted herein. The following illustration assumes component dimensions found particularly suited to the AM-CB-FM multiple band antenna application and, based thereon, calculates the antenna 10 impedance characteristic, verifying that it is as desired. Of course, a converse procedure could easily be employed to determine component dimensions necessary for operation in other desired frequency bands, such as, for example only, the Maritime Mobile, Radio Location, Radio Navigation, Public Safety or Amateur Radio frequency spectrums.

A multiple band antenna suitable for use on the AM, CB and FM bands could have the following dimensions:

| | | | |
|---|---|---|---|
| For Impedance Element 13: | | | |
| Coil $L_1$ outer radius | = | .0610 | inches |
| Coil $L_1$ length | = | 19.375 | inches |
| Coil $L_1$ inductance | = | 9.55 | μh at 7.9 MHz |
| Dielectric 18 outer radius | = | .0440 | inches |
| For Impedance Element 12: | | | |
| Coil $L_2$ turns/inch | = | 50 | |
| Coil $L_2$ outer diameter | = | 0.136 | inches |
| Coil $L_2$ length | = | 2.875 | inches |
| Coil $L_2$ inductance | = | 3.17 | μh at 7.9 MHz |
| Conductor 17 outer diameter | = | .0225 | inches |
| For Impedance Element 11: | | | |
| Conductor 14 outer radius | = | .020 | inches |
| Conductor 14 length | = | 18.375 | inches |

The above dimensions for impedance element 13 can be utilized in equation (2) to calculate impedance $Z_1$. First the characteristic impedance $Z_{01}$ can be determined from a relationship for the capacitance to ground per unit length ($C_1'$) of an unloaded vertical radiator found on page 19-8 of the first edition of the book *Antenna Engineering Handbook* by Henry Jasik $$C_1' = \frac{(2\pi)(1/36\pi)(10^{-9})}{[\ln(h/a) - 1]} \frac{\text{FARAD}}{\text{INCH}} \tag{9}$$

where h equals the length on the coil $L_1$ (in inches) and the letter a equals the radius of the coil $L_1$ (in inches). The inductance of the coil $L_1$ per unit length ($L_1'$) can be calculated from the inductance and the length of coil $L_1$, whereupon both the characteristic impedance $Z_{01}$ and the phase factor $\beta_1$ may be calculated from the respective equations $$Z_{01} = 10^3\sqrt{L_1'/C_1'} \text{ OHMS} \tag{10}$$

and $$\beta_1 = 2\pi f\sqrt{L_1'C_1} \text{ DEGREES} \tag{11}$$

Substituting these values into equation (2) it is found that for impedance element 13

$$Z_1 = j\,1382 \tan(f_{MHz} \times 2.4878) \text{ OHMS} \tag{12}$$

Next, the above dimensions for impedance element 12 are utilized in equation (3) to calculate impedance $Z_2$. In calculating the characteristic impedance $Z_{02}$, account must be taken of linear conductor 17 coaxial with coil $L_2$. Solely for purposes of determining its characteristic impedance, impedance element 12 may be treated as a cylindrical transmission line having coaxial linear and helical conductors. The relationships for inductance per unit length and capacitance per unit length of such an element, found on pages 22-27 and 22-28 of the fifth edition of the book *Reference Data for Radio Engineers,* published by Howard W. Sams & Co., Inc., are $$L_2' = 0.30\, n^2 d^2[1 - (d/D)^2] \frac{\mu h}{\text{AXIAL FOOT}} \tag{13}$$

and $$C_2' = (7.4\,\epsilon_r)/\log_{10}(D/d) \frac{pf}{\text{AXIAL FOOT}} \tag{14}$$

where n equals the number of turns per inch of coil $L_2$; d equals the outer diameter of inner conductor 17 in inches; D equals the outer diameter of coil $L_2$ in inches; and, $\epsilon_r$ equals the relative dielectric constant of the medium between the linear and helical conductors. In a manner similar to that utilized for impedance element 13, $Z_{02}$ and $\beta_2$ may be determined and substituted into equation (3), the impedance for impedance element 12, $$Z_2 = j\,766 \tan(f_{MHz} \times 1.5275) \text{ OHMS} \tag{15}$$

The impedance of capacitance $C_1$ may be determined by first determining the capacitance $C_1$ from the total inductive reactance of impedance elements 13 and 12 when series resonance occurs. At series resonant frequencies, $$C_1 = \frac{1}{\omega^2 L} = \frac{1}{\omega^2\left(\frac{X_L}{\omega}\right)} = \frac{1}{\omega X_L} \text{ FARADS} \tag{16}$$

where $X_L$ equals $Z_1$ plus $Z_2$. Because capacitance $C_1$ will vary substantially linearly, equation (16) may be solved for the value of $C_1$ at the approximate resonance frequencies of 27.1 MHz and 97 MHz, and its linear variation per MHz determined. For an antenna having the above dimensions, equations (12) and (15) yield a total inductive reactance of 3998 and 2050 ohms at 27.1 and 97 MHz, respectively, providing a capacitance $C_1$ at these respective frequencies of 1.47 and 0.80 pf and a rate of change in capacitance $C_1$ of 0.00957 pf/MHz. The values of $C_1$ may be finally substituted into equation (1) yielding the capacitive reactance of $C_1$ for all frequencies.

The impedance of the last remaining impedance element, element 11, may be found after first appreciating that standing alone impedance element 11 approximates a short vertical radiator whose characteristic impedance $Z_{03}$ and input reactance $X_{a3}$ are respectively expressed on pages 19-2 to 19-3 of Jasik, supra, as $$Z_{O3} = 60[\ln(h/a) - 1] \text{ OHMS} \tag{17}$$

AND $$X_{a3} = Z_{C3} = -Z_{O3}\cot\left(\frac{2\pi h}{\lambda}\right) \text{ OHMS} \tag{18}$$

where h is the height and the letter a is the radius of conductor 14; and λ is its wavelength of operation. For an antenna having the above dimensions for impedance element 11, the input reactance of impedance element 11 is found to be $$X_{a3} = Z_{C3} = \frac{-j402}{\tan(f_{MHZ} \times 0.67)} \text{ OHMS} \quad (19)$$

Figure 5:
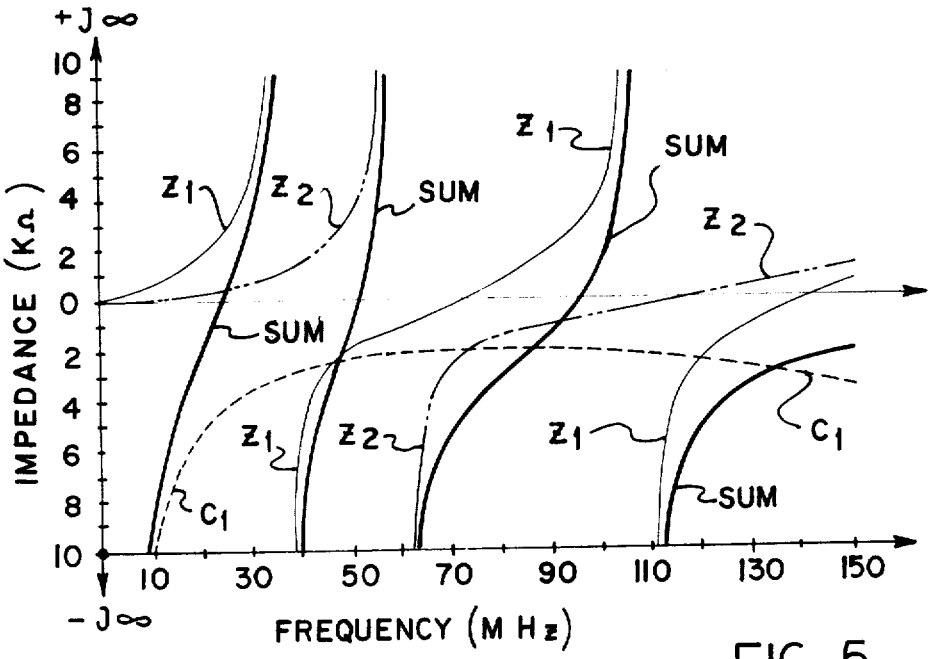
FIG. 5 is a plot of the reactance component of the calculated impedance variations with frequency of the individual lumped-circuit model series components depicted in FIG. 2, $C_1$, $Z_1$ and $Z_2$, and the total series impedance sum, $C_1+Z_1+Z_2$.

The reactance component of the calculated impedance of the individual series antenna components $Z_{01}$, $Z_1$ and $Z_2$ are plotted in FIG. 5 for all frequencies from zero to 150 MHz. The reactance component of the calculated total series impedance, $Z_{C1}+Z_1+Z_2$, indicated by the word "sum", is similarly plotted in FIG. 5. The reactance component of the calculated total input impedance of antenna 10 is plotted in FIG. 6 for all frequencies from zero to 150 MHz.

Figure 6:
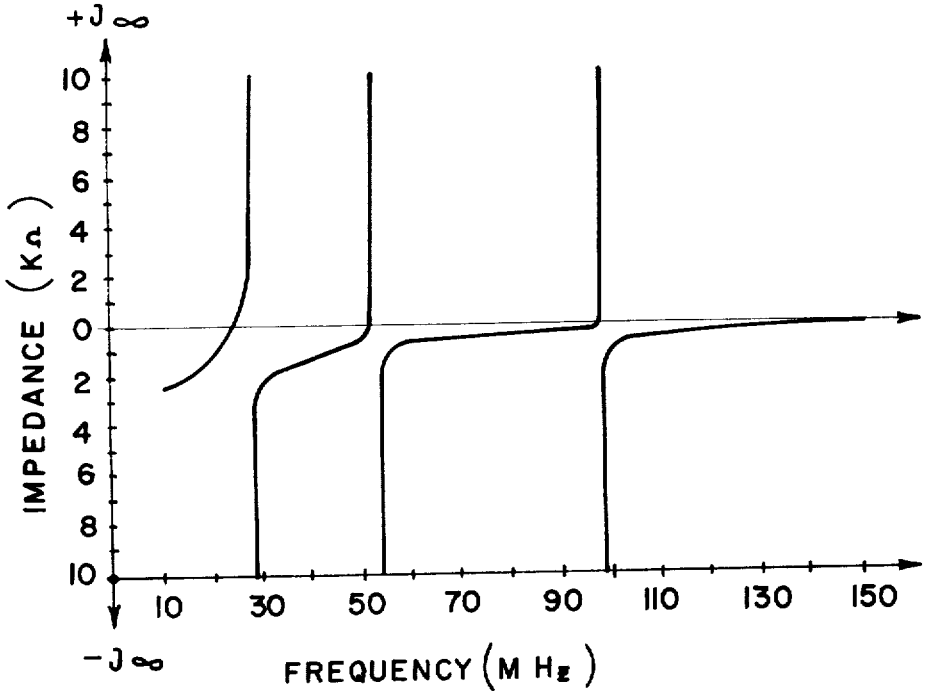
FIG. 6 is a plot of reactance component of the calculated total antenna impedance variation with frequency.

From FIGS. 5 and 6 it now may be observed that the construction of antenna 10 according to the parameters explained above will result in a single antenna having resonances substantially within a plurality of frequency bands. More particularly, it will be seen that construction of impedance element 12 to have a resonance greater than the lowest desired antenna resonant frequency and less than the highest desired antenna resonant frequencies will result in overall antenna resonant frequencies in or nearby the CB and FM broadcast frequency bands.

The operational characteristics of antenna 10 with its various operating frequency bands may be considered in order of increasing frequency: AM, CB and then FM bands. At AM broadcast band frequencies antenna 10 performs as a conventional linear radiator albeit in series with two loading coils ($L_1$ plus $L_2$), thereby providing an antenna of an apparent electrical length greater than its actual, physical length. Additionally, the increased inductive reactance of both coil $L_1$ plus $L_2$ offsets the capacitive reactance of antenna 10, furnishing better matching for AM broadcast band reception than a single, conventional AM-FM receiving antenna.

The operational characteristics of antenna 10 at its higher operating frequencies, in particular CB and FM, may be considered in conjunction with FIGS. 3 and 4, wherein the actual distribution of current along the length of antenna 10 is presented for CB frequencies (at 27.1 MHz), and for low, middle and high band FM frequencies (at 88, 100 and 108 MHz).

By appropriately selecting the resonance of impedance element 12, which is in effect a parallel LC network, above the CB frequencies, as seen in FIG. 5 impedance element 12 will have at CB frequencies a positive, or inductive, reactance substantially greater than that of a simple coil. For this reason the combination of impedance element 12 with impedance element 13 together result in resonance at CB frequencies with only approximately two-thirds of the coil length necessary if the conventional method of single coil top loading had been applied. Because of this great reduction in necessary physical length, a much greater portion of the transmitter output signal received by the antenna is radiated instead of dissipated as heat. Indeed when compared with two commercially available multiband antennas, an average increase in signal gain of at least approximately 4 dB was measured from antenna 10 throughout the CB frequency band. Additionally, notwithstanding a total absence of tuning, SWR's ranged only between approximately 1.2 and 1.8. As seen in FIG. 3, the distribution of current at 27.1 MHz substantially equals that of an ideal quarter-wavelength antenna.

By appropriately selecting the resonance of network impedance element 12 to be below FM broadcast frequencies, as seen in FIG. 5 impedance element 12 will have a negative or capacitive reactance at FM broadcast frequencies. Thus antenna 10 will, at such frequencies, behave substantially as a series RLC circuit, in which a portion of coil $L_1$ acts to cancel the capacitive reactance of impedance element 12. By selecting coil $L_1$ to be of such dimensions so as to have a small Q factor, much of the remaining current resulting from the series RLC resonance will be dissipated in the form of ohmic losses, minimizing the effects of any phase changes. Indeed, in FIGS. 3 and 4 it can be seen that throughout the FM broadcast bands while one phase change is observed at the low (88 MHz) and high (108 MHz) band frequencies and two phase changes are observed at the mid-band (100 MHz) frequency, the greatest portion of the current dissipated by antenna 10 occurs with the current in one direction along the two-thirds of the antenna closest to the radio.

Several modifications to antenna 10 within the spirit of the present invention should also be noted. First, as previously explained impedance element 12 in effect functions as a network for optimizing the characteristics of antenna 10 as described. Any impedance network which functions in the required manner may be suitable for use with antenna 10. Merely by way of example we have found that the desired network may be achieved by placing at least one conductor 17 loosely spiraled exterior to coil $L_2$. It will, of course, be appreciated that the desirability of such changes will depend on the particular frequency bands of interest, the bandwidth of signals within those bands, etc.

Another aspect of the present invention to be emphasized concerns other possible combinations and permutations of impedance elements 11, 12 and 13. For example, the skilled artisan will no doubt appreciate that coil $L_1$ was primarily utilized in the specific example herein to more readily effectuate a resonance at 27.1 MHz. Where a different combination of frequency bands are of interest, impedance elements 11 or 13 may be entirely unnecessary or at least transposable at will.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the multiple band, multiple resonant frequency antenna art.

We claim:

1. A self-tuned antenna for use with at least one radio comprising:

a linear radiator connected to the radio;

a spiral radiator; and, a network connected between said linear radiator and said spiral radiator for optimizing antenna impedance variations with frequency, said network including a first coil and at least one other conductor electrically connected to said first coil at only one end of said first coil, said conductor entwined and in operative association with said first coil throughout the entire range of frequencies of interest, resulting in the antenna having a plurality of natural resonant frequencies, each of said natural resonant frequencies occurring in separate operating bands throughout said range of frequencies of interest.

2. A self-tuned antenna for use with at least one radio, as set forth in claim 1, wherein said network has a resonant frequency greater than the lowest resonant frequency of the antenna and less than the highest resonant frequency of the antenna so as to provide resonant frequencies of the antenna substantially within at least each higher band of frequencies of interest.

3. A self-tuned antenna for use with at least one radio, as set forth in claim 2, wherein said conductor in said network is linear and coaxial with the longitudinal axis of said first coil.

4. A self-tuned antenna for use with at least one radio comprising:

a linear radiator connected to the radio;

a spiral radiator; and, a network connected between said linear radiator and said spiral radiator for optimizing antenna impedance variations with frequency, said network including a first coil and at least one other conductor electrically connected to said first coil at only one end of said first coil, said conductor entwined and in operative association with said first coil throughout the entire range of frequencies of interest, resulting in the antenna having a plurality of natural antiresonant frequencies, each of said natural antiresonant frequencies occurring in separate operating bands throughout said range of frequencies of interest.

5. A self-tuned antenna for use with at least one radio, as set forth in claim 4, wherein said network has a resonant frequency greater than the lowest resonant frequency of the antenna and less than the highest resonant frequency of the antenna so as to provide resonant frequencies of the antenna substantially within at least each higher band of frequencies of interest.

6. A self-tuned antenna for use with at least one radio, as set forth in claim 5, wherein said conductor in said network is linear and coaxial with the longitudinal axis of said first coil.

* * * * *